United States Patent [19]

Williams et al.

[11] Patent Number: 4,745,680

[45] Date of Patent: May 24, 1988

[54] INSTALLATION TOOL FOR ATTACHING ELECTRICAL ELBOW CONNECTORS

[75] Inventors: Danny R. Williams; Carl J. Wentzel, both of Houston, Tex.

[73] Assignee: Houston Industries Incorporated, Houston, Tex.

[21] Appl. No.: 933,571

[22] Filed: Nov. 21, 1986

[51] Int. Cl.[4] ..... B25B 27/02; H01R 43/00

[52] U.S. Cl. ..... 29/747; 29/278; 29/758; 29/764; 294/19.1

[58] Field of Search ..... 29/758, 747, 764, 278, 29/280; 294/19.1

[56] References Cited

U.S. PATENT DOCUMENTS

| | | | |
|---|---|---|---|
| 1,422,185 | 7/1922 | Dalitz | 29/763 |
| 3,600,784 | 8/1971 | Propst et al. | 29/758 X |
| 3,871,056 | 3/1975 | Lyons et al. | 29/278 X |
| 4,125,938 | 11/1978 | Clark | 29/764 |

*Primary Examiner*—Carl E. Hall

*Attorney, Agent, or Firm*—Pravel, Gambrell, Hewitt, Kimball & Krieger

[57] ABSTRACT

An installation tool for attaching electrical lines to electrical equipment, such as at elbow to bushing terminations. The tool readily allows firm gripping and transfer of force by a servicing worker to the elbow bushing connection to insure firm connection. It is particularly adapted for use in areas too small or confined to permit use of conventional tools.

14 Claims, 2 Drawing Sheets

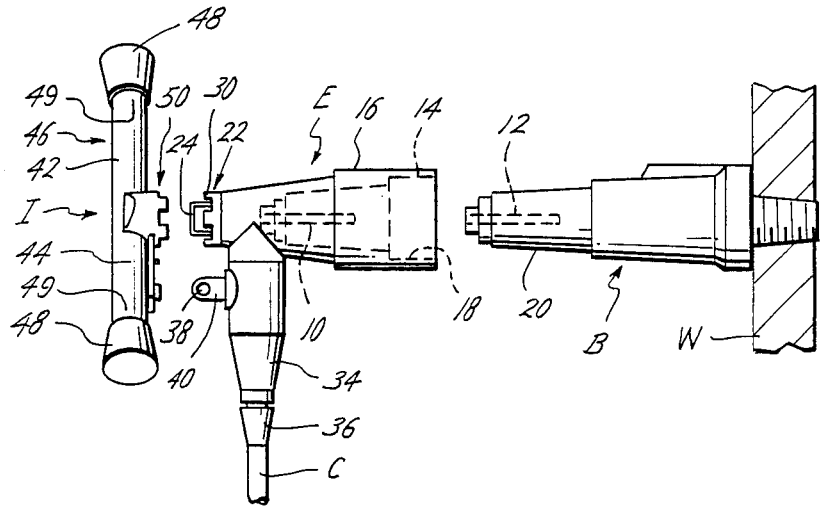
Fig. 1
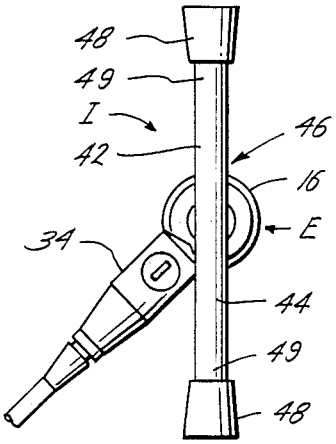
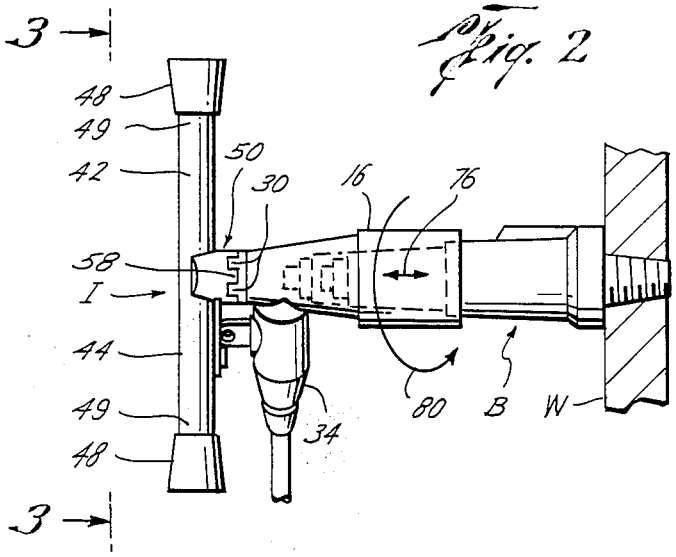
Fig. 2
Fig. 3
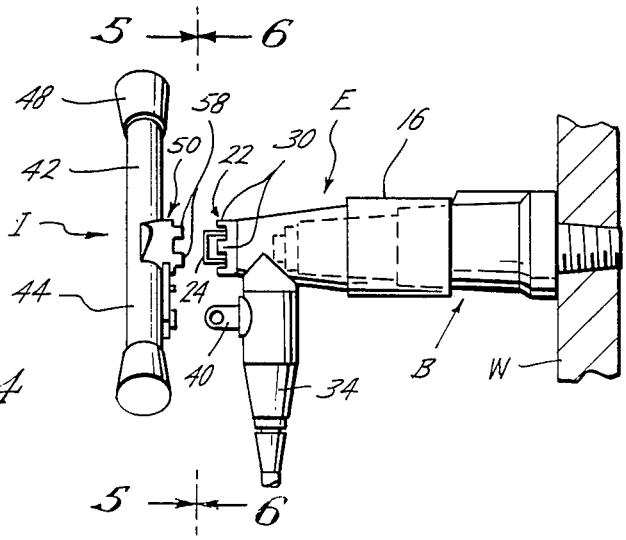
Fig. 4

INSTALLATION TOOL FOR ATTACHING ELECTRICAL ELBOW CONNECTORS

BACKGROUND OF THE INVENTION

1. Field of the Invention

The present invention relates to attaching tools for making electrical connections.

2. Description of the Prior Art

In electrical power distribution systems, high voltage connections are made between elbows at the end of cables or wires and bushings on a transformer or other equipment. In making these connections, rods or poles, typically four to ten foot long and known as "hot sticks" or "shotgun sticks", have in the past typically been used. One of the most frequent causes of failure of the elbow connection has been improper installation, which resulted from failure to apply the proper amount of force when connecting the elbow to the bushing.

The "hot stick" is an insulated rod allowing an installer or worker to safely install and service elbows and bushings at a spaced position from the electrical connection being made. The longer the shotgun stick that was used, the further the worker was spaced from a possibly live, high voltage electrical connection and thus the greater the safety. However, the longer the stick was made, the more difficult and awkward it became to make a firm and satisfactory electrical connection because of the increased distance from the connection.

This difficulty was compounded by the necessity to be sure that adequate force was exerted to insure a sufficiently firm connection of the bushing to the elbow. Additionally, the longer the stick that was used, the harder it became to sense that a proper connection was made. When the elbow was not properly installed with adequate force, it eventually caused the connection to fail or be broken. Further, there are a considerable number of pieces of power distribution equipment in restricted access areas, such as underground transformers in urban areas. In these situations, the long poles or sticks were cumbersome and difficult to use.

SUMMARY OF THE INVENTION

Briefly, the present invention provides a new and improved installation tool for attaching electrical elbow cable connectors to electrical equipment. Although not so limited in its use, it is particularly suited for use in restricted access or cramped areas.

As is typical, the electrical elbow connector has a conductive probe which is to be inserted into a receptor socket in a bushing on the electrical equipment. A grip member, preferably an insulative rod, has first and second gripping surfaces which a worker may grasp when using the tool. A mounting member is provided on the grip member between the gripping surfaces of the grip for releasably attaching the grip to the elbow connector. A worker may thus grasp the grip member with both hands to firmly force the conductive probe into the receptor socket. Once the worker has confirmed that a proper connection has been made, the grip can be rotated to insure proper alignment of the connector probe and the bushing receptor socket.

BRIEF DESCRIPTION OF THE DRAWINGS

FIG. 1 is an exploded elevation view of an elbow electrical connection being made according to the present invention.

FIG. 2 is an elevation view of an elbow electrical connection being made according to the present invention.

FIG. 3 is a view taken along the lines 3—3 of FIG. 2.

FIG. 4 is a view of an installing tool according to the present invention removed from a completed electrical elbow connection.

DETAILED DESCRIPTION OF THE INVENTION

Figure 5:
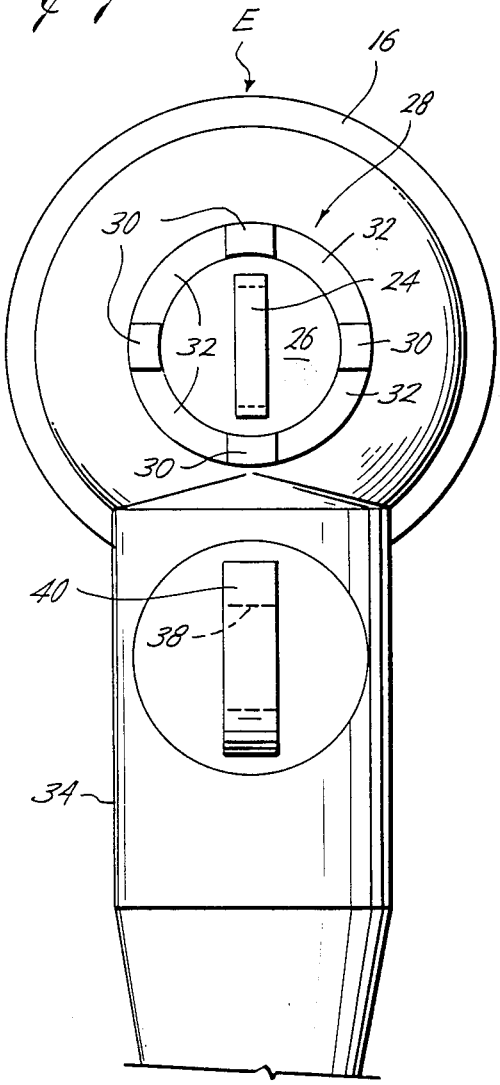
FIG. 5 is a view taken along the lines 5—5 of FIG. 4.

In the drawings, the letter I designates generally an installation tool according to the present invention for attaching an elbow electrical connector E to a conductive bushing B on a wall W of a transformer or other piece of high-power, electrical power distribution equipment. The elbow E is used to connect a high voltage electrical power distribution cable C to the transformer, typically at locations where a connection is to be made between the cable C and the transformer or the like. The voltage levels involved can be ten or twenty thousand volts or more. The electrical connection between the cable C and the bushing B is made by inserting a conductive probe 10 of the elbow E into a conductive socket 12 of the bushing B along the longitudinal axis of the probe 10 coaxially into the socket 12.

The elbow E and bushing B are conventional, commonly used items and therefore only those portions of them necessary for an understanding of the present invention will be described. The conductive probe 10 of the elbow E is mounted within a central pocket or socket 14 of a cup 16 at an upper end of the elbow E. The cup 16 is formed of a suitable strength insulative rubber or dielectric material and has an inner surface 18 conforming to an outer surface 20 of the bushing B, so that when the probe 10 and socket 12 are aligned, the probe 10 may be inserted and the cup 16 snap-fitted onto the bushing B.

The elbow E has an end cap 22 formed at an upper end opposite the cup 16 from which a U-shaped coupling bracket 24, typically of metal, rearwardly extends. The coupling bracket 24 is mounted on a recessed inner surface 26 of end cap 22. An outer rim 28 of the end cap 22 extends about the inner surface 26 in the form of a suitable number of outwardly extending guide lugs 30 spaced from each other by slots 32 formed in the outer rim 28.

A cable housing 34 of the elbow E is located between the cup 16 and a connector section 36 which receives the cable C at an end thereof. A removal eyelet 38 is formed in a rearwardly extending ear 40 on the cable housing 34 of the eyelet E.

So far as is known, in the past, the elbow E has been installed and removed from the bushing B using long rods or "shotgun sticks" which had releasable hooks at one end, permitting a worker to stand at a spaced position from the connection being made or broken for safety purposes. As has been set forth, this has presented certain problems, particularly in areas where there is cramped or limited access. With the installation tool I of the present invention, certain of these problems are overcome.

In the installation tool I, a first gripping surface 42 and a second gripping surface 44 are formed at opposite ends of an insulative gripping rod or tube 46 of a suitable insulating material, such a fiberglass or some other suitable synthetic resin. The gripping surfaces 42 and 44 may be ribbed or otherwise roughened and uneven for ease of gripping. The gripping rod 46 is typically provided with end caps or caps 48 at each opposite end 49.

Figure 6:
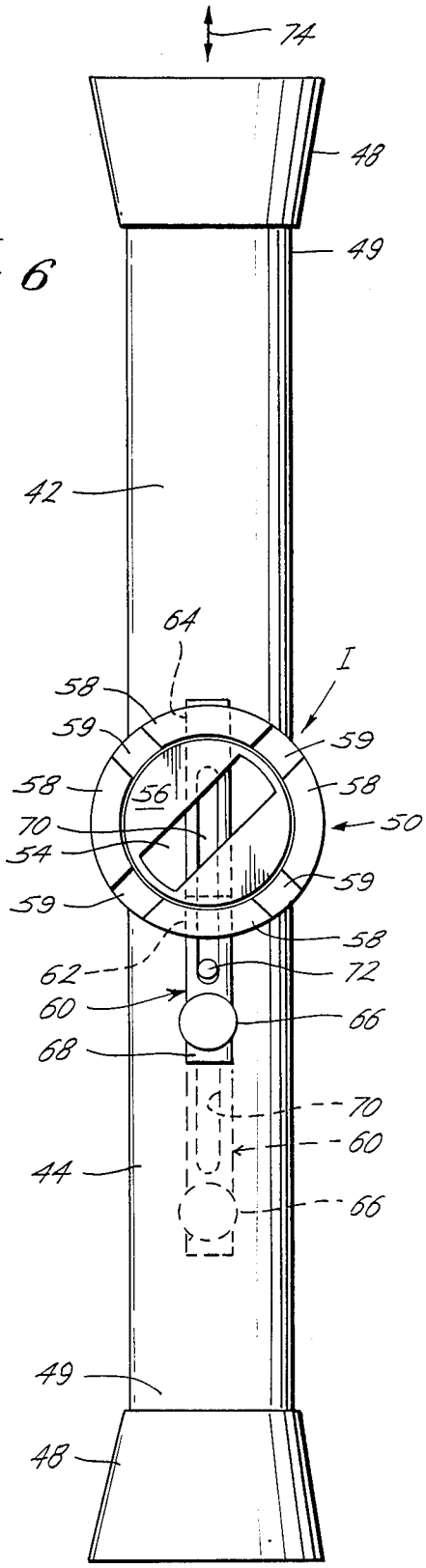
FIG. 6 is a view taken along the lines 6—6 of FIG. 4.

A mounting connector 50 is formed on the gripping rod 46 for releasably attaching the gripping rod 46 to the elbow E during installation. The mounting connector 50 takes the form of a raised, outwardly extending knob member 52 located at a central portion of the gripping rod 46 and having a key slot 54 (FIG. 6) formed extending inwardly from an inner flat portion 56 of the knob member 52. A plurality of raised shoulders 58 are formed on the knob member 52 about the periphery thereof equal in number and location to the slots 32 on the end cap 22 of the elbow E. Further, a plurality of guide notches 59 are formed in the knob member 52, equal in number to the guide lugs 30 on the end cap 22 and correspondingly situated.

The key slot 54 (FIG. 6) is of a size to receive and hold within it the coupling bracket 24 of the elbow E. A movable slide bar 60 mounted with the gripping rod 46 extends through openings 62 and 64 formed in the knob member 52 and is adapted for movement into an out of the key slot 54, as will be set forth. The slide bar 60 has a gripping lug or pin 66 formed at an outer end 68 and is adapted to be slid between a bracket engaging position, shown in FIG. 6, and an extracted position, shown in phantom in FIG. 6. A guide slot 70 is formed in the slide bar 60 longitudinally along a central portion and is adapted to receive a stop or limit pin 72 extending upwardly from gripping rod 46. The stop pin 72 limits the extent of travel of slide bar 62 the extended and retracted positions.

In the preferred embodiment shown in the drawings, the key slot 54 extends across the flat portion 56 at an angle of approximately 45° with respect to a longitudinal axis 74 of the gripping rod 46, since this provides an optimum spacing between ends 49 of the gripping rod 46 in a plane transverse that of a longitudinal axis 76 (FIG. 2) of the conductive probe 10 and socket 12 of the bushing B when the mounting connector 50 is attached to the elbow electrical connector E. It should be understood, however, that the key slot 54 may be formed extending in other directions across the surface 56 of the knob member 52. For instance, the key slot 54 may be formed extending perpendicular to the axis 74 of gripping rod. In this situation, the gripping rod 46 extends horizontally in the plane transverse that of the longitudinal axis 76 of the conductive probe 10 when the installation tool I is attached to the elbow electrical connector. Similarly, the key slot 54 can be formed to extend nearly parallel to the longitudinal axis 74 of the gripping rod 46, so long as there is clearance provided for the slide bar 60 through the connector bracket 24 of the elbow E. In that situation, the installation tool I would extend substantially vertically in the plane transverse that of the longitudinal axis 76 of the conductive probe 10 when the installation tool I is attached to the elbow electrical connector E.

In the operation of the present invention, it is desirable that the installation tool I be used only when it has been made certain that the cable C and the equipment to which it is to be connected by the elbow E are de-energized. This is because of the proximity of the installing worker's hands to the connection to be made or broken. The slide bar 56 is then moved to its retracted position, shown in phantom in FIG. 6, and the coupling bracket 24 of elbow E inserted into the key slot 54 of the mounting connection 50. The guide lugs 30 on the end cap 22 are then fitted into the guide notches 54 on the knob member 52 (FIG. 2) and, correspondingly, the raised shoulders 58 on the knob member 52 are fitted within the slots 32 on the end cap 22 of the elbow E.

The slide bar 56 is then moved inwardly through the key slot 54 in the knob member 52, locking the installation tool I to the elbow E. The probe 10 of elbow E is then aligned with the socket 12 of the bushing B and the cup 16 slid onto the outer surface of the bushing B.

With the present invention, the installing worker is able to verify the alignment of the probe 10 and socket 12 along their longitudinal axis 76 during installation. The installing worker is also able to exert sufficient force, due to the ability to grip the installing tool I with both hands, to firmly force the conductive probe 10 into the receptor socket 12. Once the worker has confirmed that a proper, firm mechanical connection has been made, the gripping rod 46 may be rotated, as indicated schematically by an arrow 80 in FIG. 2, to insure proper alignment of the installed elbow E. Further, the installing worker is able to sense the establishment of a firm, proper mechanical and electrical connection of the elbow E to the bushing B by either hearing such connection being completed or feeling it through the installing tool I.

The foregoing disclosure and description of the invention are illustrative and explanatory thereof, and various changes in the size, shape and materials, as well as in the details of the illustrated construction may be made without departing from the spirit of the invention.

We claim:

1. An installation tool for attaching an elbow electrical connector, which includes an installation bracket, to a conductive bushing on a piece of electrical equipment, comprising:

(a) grip means having first and second gripping surfaces;

(b) mounting means for releasably attaching said grip means to the electrical elbow connector, said mounting means comprising:

(1) means for receiving the installation bracket of the elbow electrical connector, said means for receiving comprising:

(i) a knob member extending outwardly from said gripping surfaces of said grip means; and (ii) said knob member having a key slot formed therein for receiving the installation bracket of the elbow electrical connector;

(2) means movable through said means for receiving to selectively engage the installation bracket of the elbow electrical connector; and (c) said mounting means being located between said gripping surfaces of said grip means.

2. The structure of claim 1, wherein:

said grip means comprises an insulative rod.

3. The structure of claim 1, wherein the elbow electrical connector includes a conductive probe adapted to be inserted along its longitudinal axis coaxially into a socket in the bushing, and wherein:

said grip means extends in a plane transverse that of the longitudinal axis of the conductive probe when said mounting means is attached to the elbow electrical connector.

4. The structure of claim 3, wherein:

said grip means extends vertically in the plane transverse that of the longitudinal axis of the conductive probe.

5. The structure of claim 3, wherein:

said grip means extends horizontally in the plane transverse that of the longitudinal axis of the conductiver probe.

6. The structure of claim 3, wherein:

said grip means extends at an angle from vertical in the plane transverse that of the longitudinal axis of the conductive probe.

7. The structure of claim 1, wherein the electrical elbow connector includes a conductive probe adapted to be inserted along its longitudinal axis coaxially into a socket in the bushing, and wherein:

said grip means extends in a plane perpendicular to that of the longitudinal axis of the conductive probe when said mounting means is attached to the elbow electrical connector.

8. The structure of claim 1, wherein:

said mounting means is centrally located on said grip means between said gripping surfaces.

9. The structure of claim 1, wherein said gripping surfaces extend between first and second ends of said grip means and further including:

end caps attached to said ends of said grip means.

10. The structure of claim 1, wherein said means movable through said means for receiving comprises:

slide bar means movable transversely through said key slot in said knob member to engage the installation bracket of the elbow electrical connector.

11. The structure of claim 10, wherein said slide bar means has a slot formed longitudinally therein and further including:

stop pin means extending from said grip means into said slot in said slide bar means for limiting movment thereof.

12. The structure of claim 10, further including:

grip lug means formed on said slide bar means for enabling movement thereof.

13. The structure of claim 1, wherein the elbow electrical connector has raised guide lugs formed about the installation bracket, and wherein:

said knob member has guide notches receiving and mating with the guide lugs of the elbow electrical connector.

14. The structure of claim 1, wherein the elbow electrical connector has spaced raised guide lugs with gaps therebetween formed about the installation bracket, and wherein:

said knob member has a raised shoulder fitting in and mating with the gaps between the lugs in the elbow electrical connector.

* * * * *

UNITED STATES PATENT AND TRADEMARK OFFICE

CERTIFICATE OF CORRECTION

PATENT NO. : 4,745,680

DATED : May 24, 1988

INVENTOR(S) : Danny R. Williams and Carl J. Wentzel

It is certified that error appears in the above-identified patent and that said Letters Patent is hereby corrected as shown below:

Column 3,line 4, delete "a" and insert --as--.

Column 3, line 8, delete "caps" and insert --cups--.

Column 3, line 27, delete "an" and insert --and--.

Column 5, line 8, delete "conductives" and insert--conductive--.

Signed and Sealed this

Eleventh Day of October, 1988

*Attest:*

DONALD J. QUIGG

*Attesting Officer*

*Commissioner of Patents and Trademarks*